US005645464A

United States Patent [19]

Chen

[11] Patent Number: 5,645,464

[45] Date of Patent: Jul. 8, 1997

[54] SUSTAINABLE ASSEMBLY BLOCKS

[76] Inventor: Yen-Shing Chen, 3FL, 23, Alley 4, Lane 155, Pateh Rd., SEC 3, Taipei, Taiwan

[21] Appl. No.: 620,600

[22] Filed: Mar. 22, 1996

[51] Int. Cl.[6] ..... A63H 33/06; A63H 33/08

[52] U.S. Cl. ..... 446/120; 446/126; 403/300

[58] Field of Search ..... 446/120, 121, 446/122, 125, 126, 128, 88; 403/300, 305, 306, 217

[56] References Cited

U.S. PATENT DOCUMENTS

| | | | |
|---|---|---|---|
| 2,843,971 | 7/1958 | Gardellin | 446/112 |
| 2,885,822 | 5/1959 | Onanian | 446/121 |
| 3,413,752 | 12/1968 | Perry | 446/121 |
| 3,597,874 | 8/1971 | Ogsbury | 446/120 X |
| 3,611,620 | 10/1971 | Perry | 446/121 |
| 3,681,870 | 8/1972 | Alpert | 446/122 |
| 3,822,499 | 7/1974 | DeVos | 446/121 |
| 4,947,527 | 8/1990 | Hennig | 446/120 X |
| 5,306,198 | 4/1994 | Forman | 446/120 |
| 5,486,127 | 1/1996 | Wolfe | 446/120 |

FOREIGN PATENT DOCUMENTS

| | | | |
|---|---|---|---|
| 3303203 | 8/1984 | Germany | 446/121 |
| 1544500 | 4/1979 | United Kingdom | 446/422 |

*Primary Examiner*—Robert A. Hafer
*Assistant Examiner*—D. Neal Muir
*Attorney, Agent, or Firm*—Thomas I. Rozsa; Tony D. Chen

[57] ABSTRACT

A switch lock plays a key role to combine a plurality of four embodiments covering Cube, Trigonal Prism, Right Pyramid, and Quadrant Column plus accessary Segment Column blocks through a ring opening lying centrally on every side of these embodiments, except of Segment Column only one surface sharing it. By the sliding between rounded corners and that happening between sphere surfaces, assembly purpose is then achieved. What they really touch is only three small pieces of are and six points; therefore, assemblage and disassemblage among blocks turn much easier. After assemblage, six semi-circular knobs below the ring opening will stable hold the middle lower part of three ball-like projections on the enlarged head of the switch lock in pairs by the strength of expelling each other. In addition, taking the advantage of expelling each other between the rounded corner behind a neck line and that below the head of the switch lock, the blocks can match each other firmly and correspondingly without any rotation.

17 Claims, 4 Drawing Sheets

SUSTAINABLE ASSEMBLY BLOCKS

BACKGROUND OF THE INVENTION

Modern city living and the fast development of industry have caused people to worry about the exhaustion of resources, especially in the overwhelming use of plastic materials which may destroy the earth's environment. Abandoned articles are substantially increasing, thereby causing garbage and waste problems which are hazardous to the environment.

It is well known that the majority of assembly block toys currently sold in the market are made from various plastic materials. None of the prior art toy block assemblies are practical and attractive for children of all ages. One might play with many different sets of toy blocks from childhood to adulthood due to the lack of interest in and the limited practical use of the toy blocks.

Generally, blocks currently in the market have the four following disadvantages:

1. they can not be mounted from every side, resulting in less space application;
2. the angle cannot be changed, for example, almost all of the toy blocks have only a 90 degree or 45 degree angle, which cannot satisfy children's creative ability and imagination;
3. right or left direction are not able to be secured, thereby rectification must be made during assemblage and achievement of the conformity of the direction must be guided; and
4. dismounting is difficult, and therefore the interest of the child is lost and the child has no desire to reassemble the toy blocks.

In order to overcome the above mentioned problems, the present invention utilizes new concepts of a new way to assemble toy blocks which include eight (8) advantages which are as follows:

A. to initiate creative ability;

B. to use both hands vigorously and increase the coordination between hands and brain;

C. to enhance children's space concept through the relationship among point, line, plane, and volume;

D. understand the concepts of number, quantity, form, color, angle, and symmetry;

E. to train the child's thinking ability especially in the development of balance and layout;

F. to be used as teaching assistant tools especially in the design of pictures;

G. to achieve economic efficiency, more collection of Sustainable Assembly Blocks, more fun with more and more games, not only used in an entire lifetime but also turning it into a family treasure which is passed down from generations to generations without losing efficiency; and H. saving resources and meeting the earth protection request, and creating family fun for all ages.

SUMMARY OF THE INVENTION

The present invention is sustainable assembly blocks which includes a plurality of four types of units coveting a cube, a trigonal prism, a right pyramid, and a quadrant column, all of which are hollow with each respective surface having a centrally located ring opening to link it with a switch lock. The cube's six equal square sides are the same with two square surfaces of the quadrant column, three of trigonal prism, and one of the right pyramid. The two equilateral triangles of the trigonal prism are the same with four of the right pyramid. Interesting blocks are easily interlocked together. If necessary, the trigonal prism blocks cannot only connect together with cube blocks but can also connect with quadrant column blocks; assembly basis is then formed and the switch lock plays a key role. Combinations occur between same type and different types plus segment column blocks as necessary to connect with the above four block embodiments. The sustainable assembly blocks can create thousands of articles with unending changes.

The object of the present invention is to provide intelligent development, entertainment, practical use, sustenance, economy, and earth environment protection.

BRIEF DESCRIPTION OF THE DRAWINGS

FIG. 6 is a side elevational view of the axis-like holds with 2 separate semi circular knobs at both sides, and the dashed line showing the layer where a neck line goes through.

DESCRIPTION OF THE PREFERRED EMBODIMENT

Figure 1:
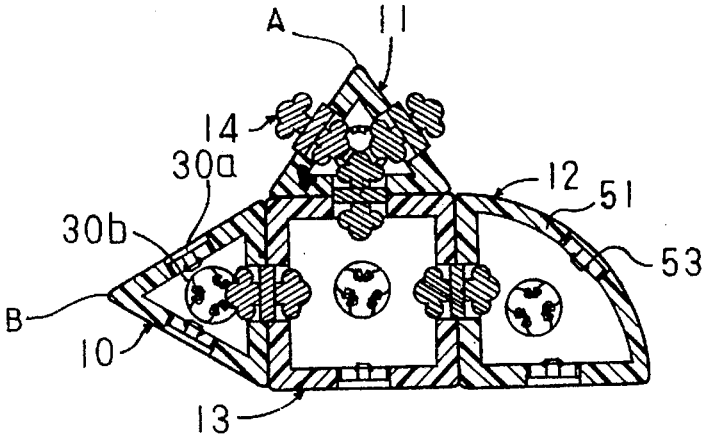
FIG. 1 is a cross-sectional view of the present invention sustainable assembly blocks, linking the trigonal prism, the right pyramid, quadrant column, and cube blocks by the switch locks, where the right pyramid has adequate space to accommodate the switch locks from different sides.

FIG. 1 is a cross-sectional view illustrating a cube 13 block combined with one trigonal prism 10, one right pyramid 11, and one quadrant column 12 by using switch locks 14. The surface thickness of the four blocks are the same except that of the curve side on the quadrant column 12 is ⅓ less than the other surface thickness, which allows the same switch lock to access into the curve side. The inside situations of the four embodiments are also shown clearly with back view 30*b* and side view 30*a* of the ring opening 30. The right and left sides of the right pyramid 11 are inserted with one switch lock 14, where the hollow right pyramid 11 has adequate space to accommodate the switch locks 14 when pushed from every side.

The cube block 13 is surrounded by the trigonal prism block 10 from the left side, the right pyramid block 11 from the top side, and the quadrant column block 12 from the right side, and shows that all of the four embodiments have the same square surface to interconnect one another. The right pyramid block 11 stands next to the trigonal prism block 10 to show their similarities and their differences, that is, they posses the same equilateral triangle (the former with four, the latter with two), but their heights are different. The height of the right pyramid block 11 is equal to the height of the trigonal prism block 11. In others, referring to FIG. 1, the height of the right pyramid block 11 is defined as the distance from point "A" to its base adjacent to the cube block 13. The height of the trigonal prism block 10 is defined as the distance from point "B" to its base adjacent to the cube block 13. The same switch lock 14 can be used on the curved surface of the quadrant column block 12 even though its ring opening outer section is curved, therefore, the quadrant column block 12 can be combined with any other mentioned embodiments or with the same type blocks on every respective side.

Figure 2:
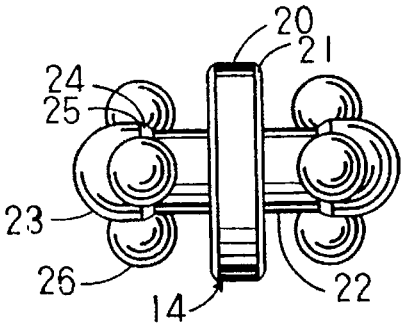
FIG. 2 is a front elevational view of the switch lock.
Figure 3:
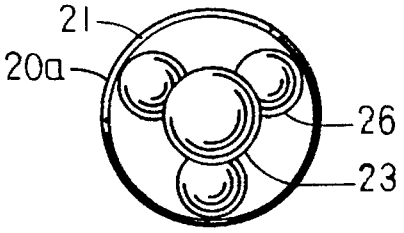
FIG. 3 is a side elevational view of the switch lock.

FIG. 2 and FIG. 3 are the illustrations of the switch lock 14. A rigid disc shaped 20 has a rounded corner 21 at both sides, its diameter being the same with that of the small central annular hole 32 surrounded by the three axis-like holds 31 located below the ring opening 30. The switch lock 14 has two opposing centrally symmetrically projecting cylindrical shafts 22. Each shaft end has an enlarged head 23 with a rounded corner 24. At assemblage, the upper edge 25 on the rounded corner 24 goes through the neck line 35, which is the narrowest and most convex layer for the enlarged head 23 to pass through the small central annular hole 32 of the ring opening 30, then the rounded corner 24 will expel with a rounded corner 36 behind the neck line 35. This makes the blocks combine more tightly.

Figure 4:
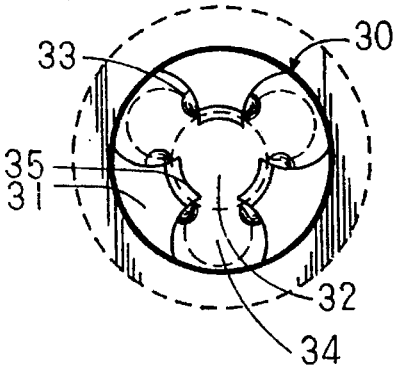
FIG. 4 is a front elevational view of the ring opening centrally located on every surface of the cube, the trigonal prism, the right pyramid, and the quadrant column blocks, where the dashed line shows the most intersection may be among the switch lock, and six semi-circular knobs at the ends of the three axis-like holds below the ring opening and a central annular hole surrounded by ends of the three axis-like holds as the switch lock is inserted into the ring opening.

In FIG. 2 and FIG. 3, there are three ball-like projections 26 disposed at 120° intervals lying on the upper edge 25 of the rounded corner 24. In FIG. 4, a dashed line is utilized to describe the most amount of resistance which the enlarged head 23 of the lock switch 14 will face as it is inserted into the ring opening 30 with the three ball-like projections 26. In other words, the surface at the neck line 35 (the three axis-like holds 31) and the surface of the rigid disc shaped 20 of the switch lock 14 abut one another. Two of the six semi-circular knobs 33 are respectively located adjacent to each one of the three axis-like holds 31 which is below the surface of the ring opening 30, where the circular knobs 33 are located within the hollow block. A small central annular hole 32 is surrounded by the three axis-like holds 31.

Figure 7:
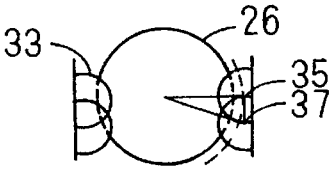
FIG. 7 is a simplified drawing, showing the intersection becomes less if the semi-circular knobs move further away from the 3 ball-like projections of the switch lock head.
Figure 6:
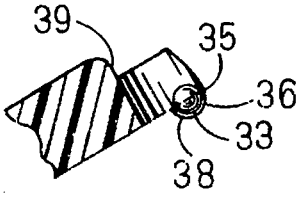

As the enlarged head 23 pushes open the three axis-like holds 31, the 3 ring apertures 34 each provided by two adjacent axis-like holds 31 will turn a little bigger until the upper edge 25 of rounded corner 24 on the enlarged head 23 passes through the neck line 35, the three axis-like holds 31 then resiliently go back to their original positions. At this time, only one more strength is needed to push its three ball-like projections 26 passing through the neck like. FIG. 2 and FIG. 6 clearly display the three ball-like projections 26 which pass through the neck line together with said upper edge 25 on the rounded corner 24 of the enlarged head 23. Once crossing the neck line 35, they are respectively pushed against the six semi-circular knobs 33. In addition, the rounded corner 24 will expel the rounded corner 36 on the outward faces of three axis-like holds 31, plus the resilient recovery strength pulls the three axis-like holds 31 back, the three doors (axis-like holds 31) almost turn off back automatically and the blocks are then secured to the rigid disc 20 of the switch lock 14. The stability can be seen from FIGS. 4 and 7. In FIG. 4, each pair of semi-circular knobs 33 are fastened firmly to one ball-like projection 26 at its middle lower part so that the switch lock cannot further move right or left. FIG. 7 illustrates the changed relationship between the ball-like projections 26 and the semi-circular knobs 33 from three ball-like projections passing the neck line 35 to their final position 37.

Figure 5:
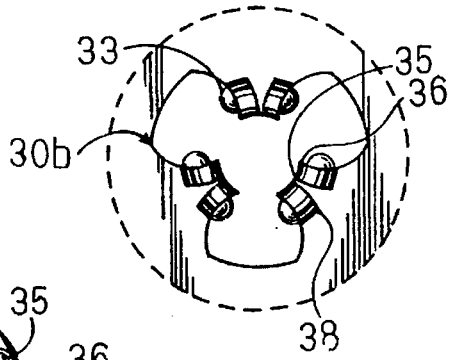
FIG. 5 is a back elevational view of the ring opening illustrated in FIG. 4.

FIG. 5 is the back view of FIG. 4. FIG. 6 is the side view of one of the axis-like projections 31, where a dashed line shows the position on which a neck line lies. There is a pair of separate bending semi-cylindrical supports 38 fixed back to back below every axis-like hold 31 at its ending sides to support the semi-circular knob 33; they are designed to absorb some pressure as the ball-like projections 26 press the semi-circular knobs 33 and allow the ball-like projections to be capable of crossing the neck line 35 smoothly. The height 39 offing opening 30 is displayed in FIG. 6 and is designed to be half the thickness of the rigid disc 20, that is, one ring opening 30 of blocks can only join one half of switch lock 14, the other half being left for combining with any other blocks.

In FIG. 7, as the ball-like projections 26 lead through the neck line 35 and once they reach the settle-down position 37, they will expel each other with the semi-circular knobs 33 and the expelling pressure (displayed by plane intersection as mentioned above), which is reduced by approximately 40%. This means the ball-like projections 26 are properly supported by semi-circular knobs 33 at their middle lower position, and are not secured too tightly. On the contrary, as the switch locks 14 are disassembled from the ring openings 30 with the three ball-like projections drawing back from settle-down position 37 to the neck line 35, the expelling pressure between ball-like projections 26 and the six semi-circular knobs is not great.

From FIGS. 2, 6, and 7, disassemblage can proceed with two steps: first, as the three ball-like projections 26 on the enlarged head 23 pull back from settle-down position 37 to the upper edge 25 position on the rounded corner 24, they face greater resistance; second, using a little strength to pull until the three ball-like projections go down and pass through the neck line together with the upper edge 25. To save strength, assembly among blocks can also be done by two steps; first, from the enlarged head 23 of switch lock 14 pushing open the three axis-like holds 31 up to the three ball-like projections 26 facing greater resistance; second, using a little strength to push until the upper edge 25 on the rounded corner 24 with 3 ball-like projections 26 pass through the neck line.

Figure 8:
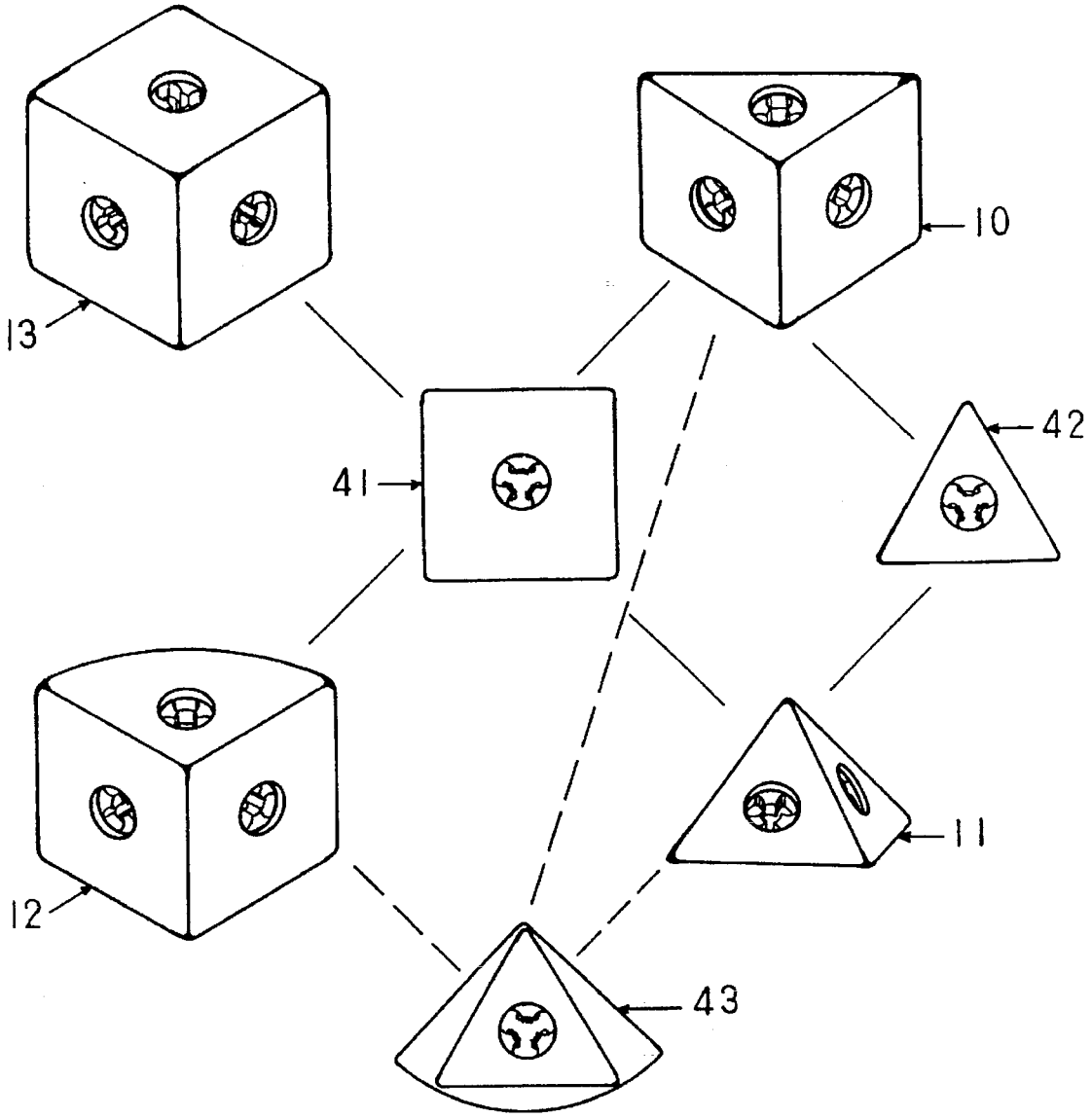
FIG. 8 are perspective views, showing the relationship among the cube, the trigonal prism, the right pyramid, and the quadrant column blocks.

FIG. 8 shows the relationship among blocks of the cube block 13, the quadrant column block 12, the right pyramid block 11, and Trigonal Prism 10. All of the four configurations can interconnect to one another by sharing the same square surface 41 (six on cube 13, two on quadrant column 12, three on trigonal prism 10, and one on right pyramid 11) as well as trigonal prism 10 and right pyramid 11 sharing same equilateral triangle 42 (two on the former, four on the latter). Blocks with equilateral triangle 42 can connect both with those having a square surface 41 and, if necessary, with quadrant column 12 having two sides of quadrant surface as number 43 shows. This is a composite description and the switch lock 14 plays a key role for combination, plus the assembly among the same type of blocks as well as using accessory segment column 15 to link with these embodiments. Therefore, the sustainable assembly block has unlimited configurations.

Figure 9:
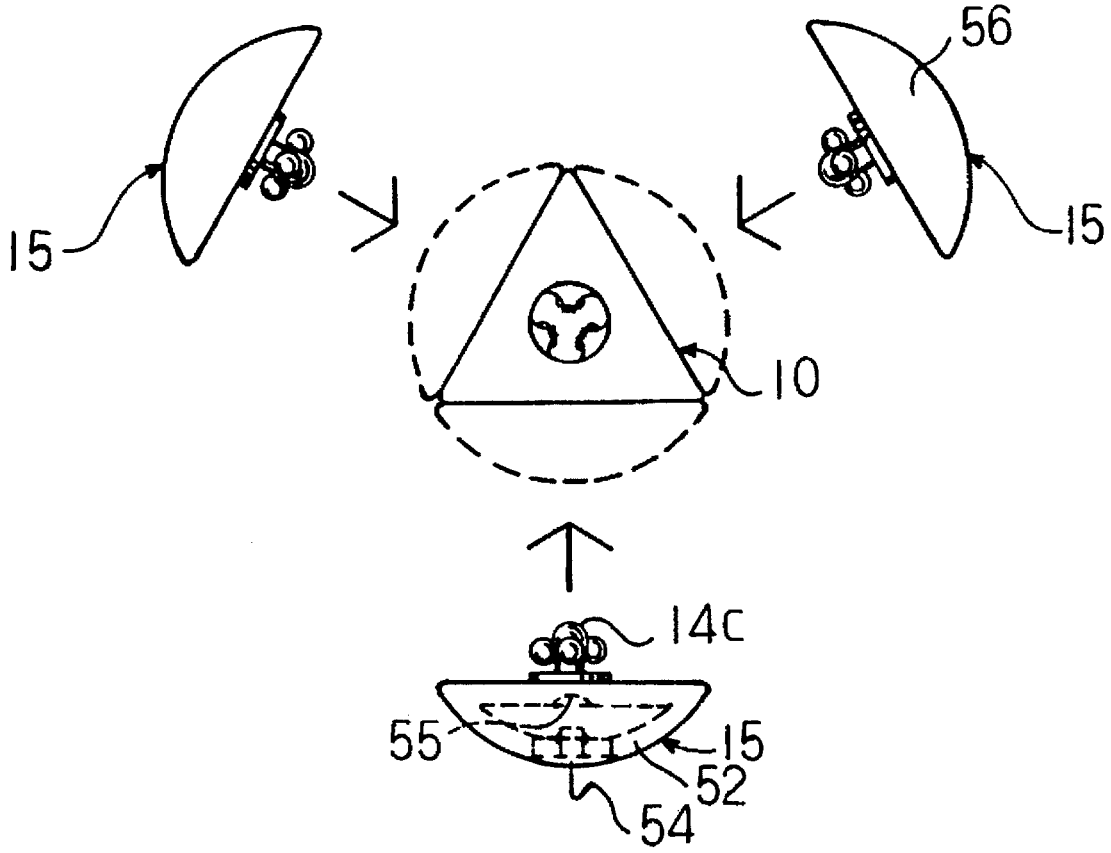
FIG. 9 is a front elevational view, showing how the three segment columns are connected together with one trigonal prism, and thereby forms a cylinder. Dashed lines show the segment column blocks in a connected condition.

FIG. 9 discloses a front view of how three segment columns 15 as accessories combine with one trigonal prism 10 and achieve a cylinder. Segment column 15 accessory is designed to own the square surface 41 but on its center is pre-fastened half a switch lock 14*c* instead of a ring opening. The segment column 15 also has a ring opening 54 located on the center of its curved surface having a difference from ring opening 30 in curve edge but still can absorb the switch lock 14 for combination with any other embodiments. The remaining surfaces are two segments 56 without any openings or projections on them. One of the three segments columns shows its interior situation, edge thickness is ⅔ compared with any other types of embodiments and a semi-circular socket lies behind the pre-fastened half switch lock 14*c* for housing a switch lock 14 from the ring opening 54.

Figure 10:
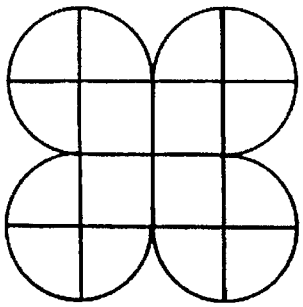
FIG. 10 is an illustration of a water-drop-like pattern each composed by three quadrant column blocks and one cube block.

In sustainable assembly blocks, players can first assemble various simple shapes, use these simple shapes as units to find their symmetry, and add color match; they can develop their imagination and create more than one thousand different beautiful pictures in two dimensional space just like the theory of the kaleidoscope. Following are six examples:

FIG. 10 is an illustration of a water-drop-like pattern each composed by three quadrant column blocks 12 and one cube block 13 in a front view.

Figure 11:
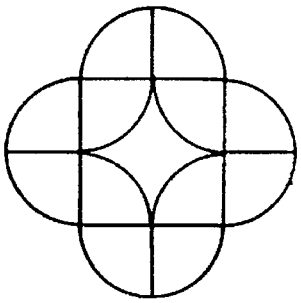
FIG. 11 is an illustration of a cicada-like pattern each formed by three quadrant column blocks.

FIG. 11 is an illustration of a cicada-like pattern each formed by three quadrant column blocks 12 in a front view.

Figure 12:
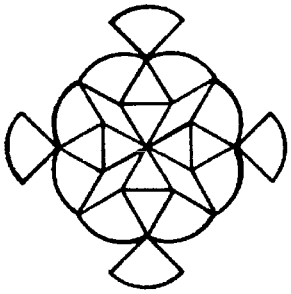
FIG. 12 is an illustration of a bird-like pattern each formed by three quadrant column blocks and two trigonal prism blocks.

FIG. 12 is an illustration of a bird-like pattern each formed by three quadrant column block 12 and two trigonal prism blocks 10 in accordance with the present invention.

Figure 13:
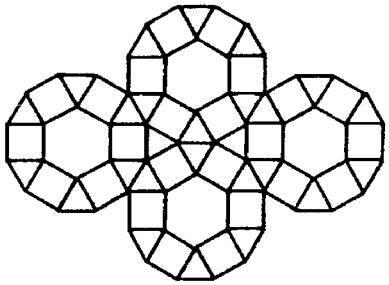
FIG. 13 is an illustration of an annular pattern each with six cube blocks and six trigonal column blocks.

FIG. 13 is an illustration of an annular pattern each with six cube blocks 13 and six trigonal column blocks 10 relating to the present invention.

Figure 14:
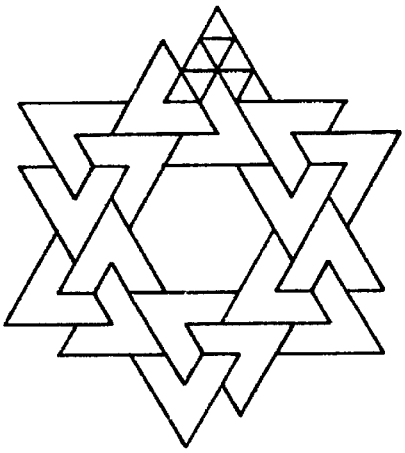
FIG. 14 is an illustration of a V upside-down pattern assemblage each combined with eight trigonal prism blocks.

FIG. 14 is an illustration of a V upside-down pattern assemblage each combined with eight trigonal prism blocks 10 according to the present invention.

Figure 15:
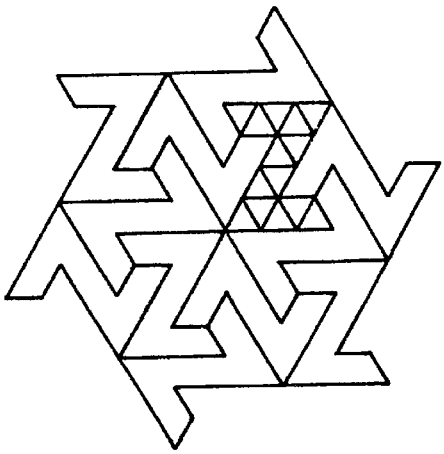
FIG. 15 is an illustration of a Z pattern assemblage each with 14 trigonal prism blocks.

FIG. 15 is an illustration of a Z pattern assemblage each with fourteen trigonal prism blocks 10.

Certainly, the sustainable assembly blocks can work marvelously in three dimensional space and create thousands of changes in forms, shapes, volumes, etc. Following is a brief description for combination methods in big volumes:

1. point to point and united to a line;
2. line to line, united to a plane by selecting two points among them;
3. plane to plane, united to a volume utilizing three points among them; and
4. volume to volume, united to a bigger volume utilizing four points among them.

At disassemblage, it is better not to dismount the switch locks 14 but instead leave them there for more convenience at new assemblage next time.

What is claimed is:

1. A block assembly, comprising:

a. at least two blocks, each having at least one wall with an opening, a flange located adjacent to and recessed within the opening, a central aperture and at least two holes, in communication with said aperture located in the flange;

b. knob retaining means located adjacent to each one of said at least two holes and attached to said flange;

c. a switch lock having a rigid disc and two shafts attached at opposite sides of the rigid disc, each shaft having a head remote from the rigid disc and at least two projection means; and d. said heads and said at least two projections of said switch lock being insertabe through said openings and said at least two holes of said at least two blocks respectively, and insertable to engage said at least two projections with said retaining means for interconnecting said at least two blocks, where said rigid disc of said switch lock abuts against said flanges and is located within said openings of said at least two blocks.

2. The block assembly in accordance with claim 1 wherein each of said at least two blocks includes generally a cube shape.

3. The block assembly in accordance with claim 1 wherein each of said at least two blocks includes generally a quadrant column shape.

4. The block assembly in accordance with claim 1 wherein each of said at least two blocks includes generally a trigonal prism shape.

5. The block assembly in accordance with claim 1 wherein each of said at least two blocks includes generally a right pyramid shape.

6. The block assembly in accordance with claim 1 wherein said retaining means include at least two semi-circular knobs.

7. A sustainable toy building block assembly, comprising:

a. a plurality of hollow block members, each hollow block member having at least two block walls, each block wall having a central ring opening, an annular surrounding flange located adjacent to and recessed within the central ring opening, and three equally spaced apart holes located on the annular surrounding flange and extending in a radial direction and communicating with the central ring opening;

b. two opposite semi-circular shaped knobs located adjacent to each one of said three equally spaced apart rounded shaped holes and integrally connected to said annular surrounding flange;

c. a switch lock having a rigid disc and two symmetrical shafts integrally attached at opposite sides of the rigid disc, each shaft having a rounded head portion remote from the rigid disc and three equally spaced apart ball shaped projection portions extending in a radial direction from the shaft and located adjacent to the rounded head portion, the diameter of the rigid disc being slightly smaller than the diameter of said annular surrounding flange, the diameter of the rounded head portion being slightly smaller than the diameter of said central ring opening, and the diameter of said each ball shaped projection portion being slightly smaller than the diameter of each one of said three rounded shaped holes; and d. said rounded head portions and said ball shaped projection portions of said switch lock being insertabe through said central ring openings and said holes of said plurality of hollow block members respectively, and insertable to engage said ball shaped projection portions with said semi-circular shaped knobs for interconnecting two adjacent ones of said plurality of block members, where said rigid disc of said switch lock abuts against said annular surrounding flanges and is located within said central ring openings of two adjacent ones of said plurality of block members.

8. The sustainable toy building block assembly in accordance with claim 7 wherein each of said plurality of hollow block members includes generally a cube shape.

9. The sustainable toy building block assembly in accordance with claim 7 wherein each of said plurality of hollow block members includes generally a quadrant column shape.

10. The sustainable toy building block assembly in accordance with claim 7 wherein each of said plurality of hollow block members includes generally a trigonal prism shape.

11. The sustainable toy building block assembly in accordance with claim 7 wherein each of said plurality of hollow block members includes generally a right pyramid shape.

12. A toy building block assembly, comprising:

a. at least two hollow block members, each hollow block member having at least one block wall with a central ring opening, an annular flange located adjacent to and recessed within the central ring opening, and at least two rounded holes located on the annular flange and extending in a radial direction and communicating with the central ring opening;

b. retaining means located adjacent to each one of said at least two rounded holes and integrally connected to said flange;

c. a switch lock having a rigid disc and two shafts integrally attached at opposite sides of the rigid disc, each shaft having a rounded head portion remote from the rigid disc and at least two ball shaped projection portions extending in a radial direction from the shaft and located adjacent to the rounded head portion; and d. said rounded head portions and said at least two ball shaped projection portions of said switch lock being insertabe through said central ring openings and said at least two rounded holes of said at least two hollow block members respectively, and insertable to engage said at least two ball shaped projection portions with said retaining means for interconnecting said at least two block members, where said rigid disc of said switch lock abuts against said annular flanges and is located within said central ring openings of said at least two block members.

13. The toy building block assembly in accordance with claim 12 wherein each of said at least two hollow block members includes generally a cube shape.

14. The toy building block assembly in accordance with claim 12 wherein each of said at least two hollow block members includes generally a quadrant column shape.

15. The toy building block assembly in accordance with claim 12 wherein each of said at least two hollow block members includes generally a trigonal prism shape.

16. The toy building block assembly in accordance with claim 12 wherein each of said at least two hollow block members includes generally a right pyramid shape.

17. The toy building block assembly in accordance with claim 12 wherein said retaining means include at least two semi-circular knobs.

* * * * *